US011423820B2

(12) United States Patent
Park et al.

(10) Patent No.: US 11,423,820 B2
(45) Date of Patent: Aug. 23, 2022

(54) DISPLAY DEVICE AND RENDERING METHOD THEREOF

(71) Applicant: LG Display Co., Ltd., Seoul (KR)

(72) Inventors: Sang-Jae Park, Paju-si (KR); Seong-Ho Cho, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/118,023

(22) Filed: Dec. 10, 2020

(65) Prior Publication Data

US 2021/0201743 A1 Jul. 1, 2021

(30) Foreign Application Priority Data

Dec. 30, 2019 (KR) ..... 10-2019-0178199

(51) Int. Cl.
*G09G 3/20* (2006.01)

(52) U.S. Cl.
CPC ... *G09G 3/2003* (2013.01); *G09G 2300/0452* (2013.01); *G09G 2320/02* (2013.01)

(58) Field of Classification Search
None
See application file for complete search history.

(56) References Cited

U.S. PATENT DOCUMENTS 7,177,482 B2 * 2/2007 Ohki ..... G06T 7/13 382/269
9,936,204 B1 * 4/2018 Sim ..... H04N 19/593
2003/0112243 A1 * 6/2003 Garg ..... G06T 9/007 345/441
2006/0077890 A1 * 4/2006 Suryavanshi ..... H04L 65/608 370/242
2008/0143659 A1 * 6/2008 Ma ..... G09G 3/3677 345/87
2011/0122950 A1 * 5/2011 Ji ..... H04N 19/51 375/E7.243
2013/0222442 A1 * 8/2013 Gu ..... G09G 3/2003 345/694
2013/0272401 A1 * 10/2013 Seregin ..... H04N 19/13 375/240.12
2013/0300771 A1 * 11/2013 Cho ..... G09G 3/3406 345/690
2013/0301715 A1 * 11/2013 Lin ..... H04N 19/593 375/240.12
2015/0117768 A1 * 4/2015 Chang ..... G06T 11/203 382/162
2015/0278132 A1 * 10/2015 Leijten ..... G09G 5/39 710/308
2016/0189354 A1 * 6/2016 Kikuchi ..... G06T 5/40 382/167
2018/0122283 A1 * 5/2018 Kim ..... G09G 3/2003
(Continued)

*Primary Examiner* — Patrick N Edouard
*Assistant Examiner* — Peijie Shen
(74) *Attorney, Agent, or Firm* — Seed IP Law Group LLP

(57) ABSTRACT

The present disclosure relates to a display device and a rendering method thereof which can reduce pattern artifacts by controlling padding data using data of a plurality of pixels neighboring a boundary, and a rendering method of a display device according to an embodiment determines smaller data or luminance values for respective colors between first and second pixel data neighboring a boundary as padding data and renders the padding data and any one of the first and second pixel data immediately neighboring the boundary for the respective colors.

11 Claims, 9 Drawing Sheets

(56) References Cited

U.S. PATENT DOCUMENTS

| | | | | |
|---|---|---|---|---|
| 2019/0313107 | A1* | 10/2019 | Park | H04N 19/154 |
| 2019/0340974 | A1* | 11/2019 | Ka | G09G 3/3225 |
| 2020/0225899 | A1* | 7/2020 | Lim | G06F 3/1423 |
| 2020/0342804 | A1* | 10/2020 | Li | G06T 5/002 |
| 2021/0035526 | A1* | 2/2021 | Yang | G09G 5/02 |
| 2021/0091145 | A1* | 3/2021 | Huangfu | G02F 1/133514 |
| 2021/0193018 | A1* | 6/2021 | Zhou | G09G 3/2074 |

* cited by examiner

DISPLAY DEVICE AND RENDERING METHOD THEREOF

CROSS-REFERENCE TO RELATED APPLICATION

This application claims the benefit of Republic of Korean Patent Application No. 10-2019-0178199, filed Dec. 30, 2019, which is incorporated by reference in its entirety.

BACKGROUND

Technical Field

The present disclosure relates to a display device and a rendering method thereof which can reduce pattern artifacts by controlling padding data using data of a plurality of pixels neighboring a boundary.

Description of the Related Art

In general, display devices display full color images using three-color (RGB) subpixels including red (R), green (G) and blue (B) subpixels. An RG-BG PenTile structure in which two-color (e.g., RG and BG) subpixels constituting each pixel are arranged in a diamond form in order to improve luminance and reduce power consumption is known.

A display in the RG-BG PenTile structure uses a subpixel rendering algorithm for performing rendering with reference to data of a current pixel and neighbor pixels of an RGB source image per color in order to use colors of neighbor pixels for colors that each pixel does not have.

Although rendering is performed for pixels positioned on left and right boundaries which do not have neighbor pixels using predetermined padding data, luminance deterioration in the first line or artifacts of recognizing a specific color line are generated at boundaries due to fixed values of the padding data.

BRIEF SUMMARY

One or more embodiments of the present disclosure provides a display device and a rendering method thereof which can reduce pattern artifacts by controlling padding data using data of a plurality of pixels neighboring a boundary.

A display device according to an embodiment includes: a panel in which each pixel is composed of subpixels of two colors from among three colors and has a different subpixel arrangement structure from those of pixels neighboring in a vertical direction and a horizontal direction; a panel driver for driving the panel; and an image processor. The image processor determines whether a position of a current pixel is a boundary at which a previous pixel or a next pixel is not positioned, determines smaller values between current pixel data and neighboring pixel data as padding data when the position of the current pixel is the boundary, calculates the determined padding data and the current pixel data for respective colors to perform a subpixel rendering process and outputs the rendered data to the panel driver.

A rendering method of a display device according to an embodiment includes: determining whether a position of a current pixel is a boundary at which a previous pixel or a next pixel is not positioned; and determining smaller values between current pixel data and neighboring pixel data as padding data when the position of the current pixel is the boundary, and calculating the determined padding data and the current pixel data for respective colors to perform subpixel rendering.

The image processor may compare the current pixel data with the neighboring pixel data for respective colors and determine smaller gradation values for the respective colors as the padding data or determine smaller luminance values for the respective colors between the current pixel data and the neighboring pixel data as padding data.

The image processor may calculate the current pixel data and the neighboring pixel data for the respective colors to perform the subpixel rendering process when the position of the current pixel is not the boundary.

When the current pixel is the first pixel immediately neighboring a left boundary of an active area, the image processor may determine smaller values for respective colors between first pixel data and second pixel data as first padding data and render the padding data of the left boundary and the first pixel data.

When the current pixel is the last M-th pixel immediately neighboring a right boundary of the active area, the image processor may determine smaller values for respective colors between M-th pixel data and (M−1)-th pixel data as padding data of the right boundary and render the M-th pixel data and the padding data of the right boundary.

The panel may have a structure in which a first pixel composed of green and red subpixels and a second pixel composed of green and blue subpixels are alternately arranged in the horizontal direction and the vertical direction.

A rendering method of a display device according to an embodiment may determine smaller data or luminance values for respective colors between first and second pixel data neighboring a boundary as padding data and render the padding data and any one of the first and second pixel data immediately neighboring the boundary for respective colors.

The rendering method according to an embodiment may respectively compares first red data, first green data and first blue data included in the first pixel data with second red data, second green data and second blue data included in the second pixel data and determine smaller red data between the first red data and the second red data, smaller green data between the first green data and the second green data, and smaller blue data between the first blue data and the second blue data as padding data.

The display device and the rendering method thereof according to an embodiment can reduce artifacts irrespective of a pattern positioned at a boundary by determining pixel data having smaller data or luminance values for respective colors between first and second pixel values neighboring the boundary as padding data and rendering the determined padding data and the first pixel values, thereby improving definition.

DETAILED DESCRIPTION

Figure 1:
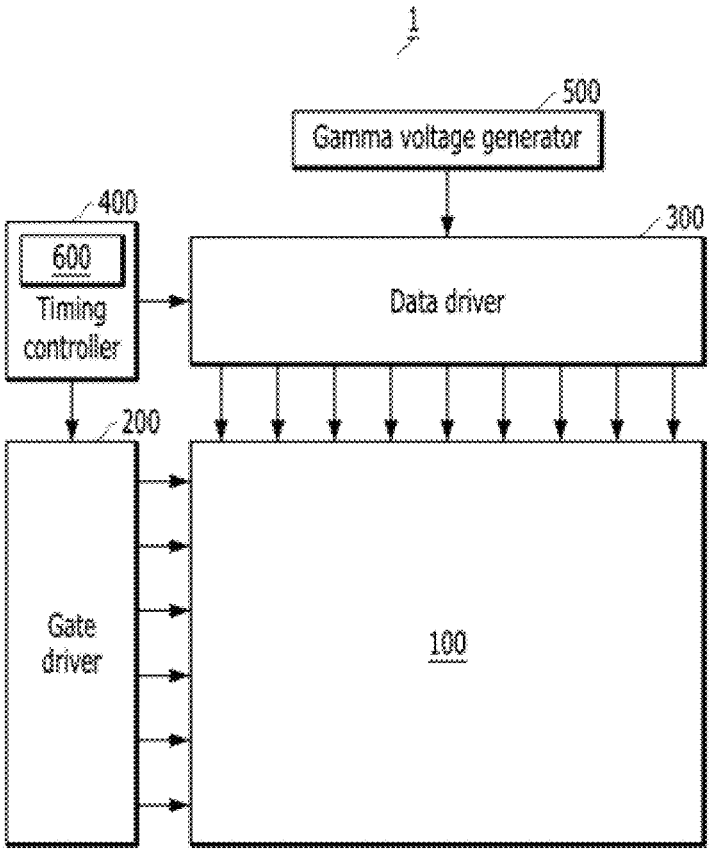
FIG. 1 is a block diagram schematically showing a configuration of a display device according to an embodiment.
Figure 2:
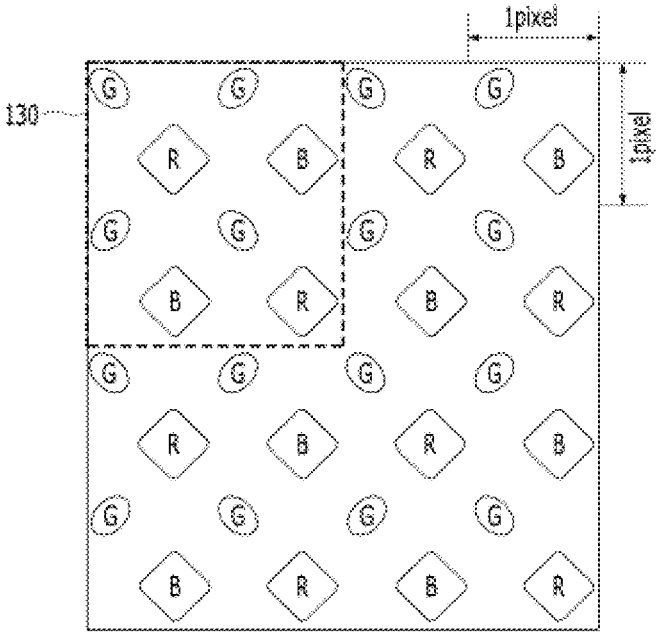
FIG. 2 is a diagram showing an RGBG pixel arrangement structure according to an embodiment.
Figure 3:
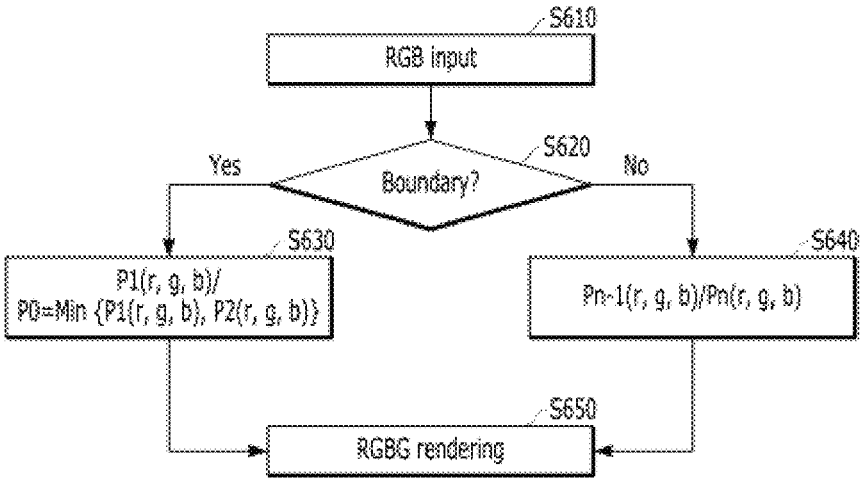
FIG. 3 is a flow chart showing a rendering method of a display device according to an embodiment.

FIG. 1 is a block diagram schematically showing a configuration of a display device according to an embodiment, FIG. 2 is a diagram showing an RGBG pixel arrangement structure according to an embodiment and FIG. 3 is a flow chart showing a rendering method of a display device according to an embodiment.

Referring to FIG. 1, a display device 1 includes a gate driver 200, a data driver 300, a timing controller 400, a gamma voltage generator 500, and the like. The gate driver 200 and the data driver 300 may be defined as a panel driver for driving a panel 100. In some embodiments, all the gate driver 200, the data driver 300, the timing controller 400 and the gamma voltage generator 500 may be defined as a driver.

The panel 100 displays images through a pixel array. The panel 100 may be any kind of display panel including a liquid crystal display (LCD) panel, an organic light emitting diode (OLED) display panel, an LED display panel and the like.

The panel 100 may be of a PenTile pixel type in which each pixel is composed of two-color (e.g., RG and BG) subpixels. A PenTile pixel structure has a higher aperture ratio (e.g., larger emission area) than that of an RGB stripe structure and thus can reduce power consumption and manufacturing costs while realizing high luminance and high resolution. Each pixel is composed of subpixels of two colors RB and BG from among three colors RGB, and a pixel group 130 including, for example, 2*2 pixels is repeated in the horizontal direction and the vertical direction to constitute a pixel array. In the PenTile structure shown in FIG. 2, red and blue subpixels R and B other than a green subpixel G may be alternately positioned in the horizontal and vertical directions.

The gate driver 200 receives a plurality of gate control signals from the timing controller 400 and performs a shifting operation to individually drive gate lines of the panel 100. The gate driver 200 supplies a scan signal at a gate on voltage (e.g., voltage that turns ON the gate) to each gate line in a driving period of each gate line and supplies a gate off voltage (e.g., voltage that turns OFF the gate) to each gate line in a non-driving period of each gate line.

The gate driver 200 according to an embodiment is composed of one or more gate integrated circuits (ICs), and the gate ICs may be individually mounted on a circuit film such as a chip on film (COF) and bonded and connected to the panel 100 through tape automated bonding (TAB) or may be mounted on the panel 100 through a chip on glass (COG). The gate driver 200 according to an embodiment may be formed on a substrate along with a thin film transistor array constituting the pixel array of the panel 100 and embedded in a non-display area of both sides or one side of the panel 100 in a gate in panel (GIP) type.

The gamma voltage generator 500 generates a reference gamma voltage set including a plurality of reference gamma voltages having different levels and supplies the reference gamma voltage set to the data driver 300. The gamma voltage generator 500 can adjust reference gamma voltage levels according to control of the timing controller 400.

The data driver 300 is controlled by a data control signal supplied from the timing controller 400, converts digital data supplied from the timing controller 400 into an analog data signal and provides the analog data signal to data lines of the panel 100. Here, the data driver 300 converts the digital data into the analog data signal using gradation voltages obtained by subdividing the plurality of reference gamma voltages supplied from the gamma voltage generator 500 and provides the analog data signal to the data lines of the panel 100.

The data driver 300 is composed of a plurality of data ICs, and the data ICs may be individually mounted on a circuit film such as a COF and bonded to the panel 100 through TAB or may be mounted on the panel 100 through a COG.

The timing controller 400 receives a three-color (RGB) source image signal and timing control signals from a host system. The host system may be any one of a computer, a TV system, a set-top box, and a system of a mobile terminal such as a tablet or a cellular phone. The timing control signals may include a dot clock signal, a data enable signal, a vertical synchronization signal, a horizontal synchronization signal, and the like.

The timing controller 400 generates a plurality of data control signals for controlling operation timing of the data driver 300 using the received timing control signals and timing setting information stored therein, supplies the plurality of data control signals to the data driver 300, generates a plurality of gate control signals for controlling operation timing of the gate driver 200 and supplies the plurality of gate control signals to the gate driver 200.

The timing controller 400 includes a processor 600 which performs various types of image processing including subpixel rendering on a received source image and outputs the processed source image to the data driver 300. In some embodiments, the processor 600 includes an image processor 600. Meanwhile, the image processor 600 may be separate from the timing controller 400 and be positioned to be connected to an input terminal of the timing controller 400. In this case, the output of the image processor 600 can be supplied to the data driver 300 through the timing controller 400.

The image processor 600 generates RGBG data corresponding to the pixel structure shown in FIG. 2 by performing a subpixel rendering process on three-color RGB data of a source image.

Referring to FIG. 3, the image processor 600 receives the RGB data of the source image (step S610) and determines whether a current pixel position of the received RGB data is a left or right boundary of an active area (step S620). The image processor 600 can determine whether current RGB data is data of the first pixel or the last pixel input in each horizontal period. For example, the image processor 600 can determine the pixel position of the current data by counting the number of dot clocks input along with data in each horizontal period.

When the pixel position of the current data is not a boundary (NO in step S620), the image processor 600 can perform a subpixel rendering process by calculating pixel data neighboring current pixel data Pn(r, g, b), that is, previous pixel data Pn−1(r, g, b), for respective colors (step S650).

When the pixel position of the current data is a boundary (YES in step S620), the image processor 600 can perform a subpixel rendering process by comparing pixel data P2(r, g, b) neighboring a current pixel data P1(r, g, b) for respective colors, determining pixel data having smaller gradation data or luminance values as padding data P0(r, g, b) and averaging the determined padding data P0(r, g, b) and the current pixel data P1(r, g, b) for respective colors (step S650).

For example, when the current pixel data P1(r, g, b) is P1(100, 200, 300) and the neighboring pixel data P2(r, g, b)

is P2(80, 220, 180), the image processor 600 determines P0(80, 200, 180) that are smaller values for respective colors as the padding data P0(r, g, b).

The image processor 600 can compare the current pixel data P1(r, g, b) with the neighboring pixel data P2(r, g, b) for respective colors and determine data having smaller values for respective colors as padding data or determine data having smaller luminance values for respective colors between the current pixel data P1(r, g, b) and the neighboring pixel data P2(r, g, b) as padding data.

In other words, the image processor 600 performs a subpixel rendering process by determining data having smaller gradation values or luminance values for respective colors between first pixel data and second pixel data neighboring left and right boundaries as padding data and averaging the padding data and any one piece of pixel data immediately neighboring a boundary from among the first pixel data and the second pixel data.

The image processor 600 can respectively compare first red data, first green data and first blue data included in the first pixel data P1(r, g, b) with second red data, second green data and second blue data included in the second pixel data P2(r, g, b) and determine a smaller one between the first and second red data, a smaller one between the first and second green data and a smaller one between the first and second blue data as padding data.

The image processor 600 can render pixel data by averaging current pixel data and previous pixel data while shifting pixels one by one for the source image. For example, the image processor 600 can render the padding data P0 and the first pixel data, render the first pixel data and the second pixel data, and then render the second pixel data and the third pixel data.

When the pixel position of the current data is the last M-th pixel positioned at the right boundary, the image processor 600 can perform a rendering process by determining a smaller one between the (M−1)-th pixel data and the M-th pixel data as padding data of the right boundary and averaging the determined padding data and the M-th pixel data for respective colors. In one embodiment, M is a natural number. In other embodiments, M is a natural number that is equal to or greater than 2.

In this manner, the image processor 600 can reduce artifacts irrespective of a pattern positioned at a boundary by determining pixel data having smaller data or luminance values for respective colors from among first and second pixel values in proximity to the left or right boundary as padding data and rendering the determined padding data and the first pixel values, thereby improving definition.

The image processor 600 may additionally perform degamma correction that is a preprocessing procedure prior to subpixel rendering and gamma correction that is a post-processing procedure after the subpixel rendering process. The image processor 600 may additionally perform a plurality of types of image processing such as color temperature tuning, deterioration correction, and luminance correction for power consumption reduction prior to gamma correction.

FIGS. 4 to 9 show subpixel rendering results with respect to boundary patterns according to an embodiment.

Figure 4:
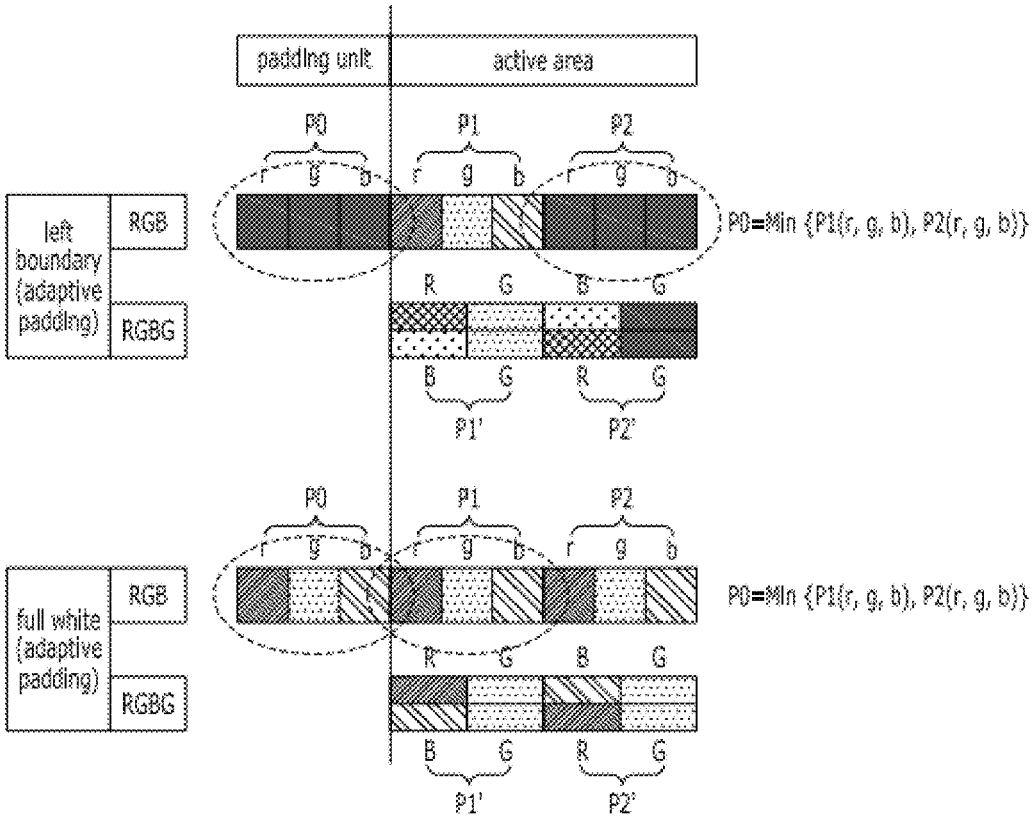
FIGS. 4 to 9 are diagrams showing subpixel rendering results with respect to boundary patterns according to an embodiment.

Referring to FIG. 4, the image processor 600 can determine, as padding data P0, three-color data (black data) of a second pixel P2 having smaller color values between the first and second pixels P1 and P2 neighboring the left boundary in the active area. When the three-color data of the first pixel P1 is the same full white data as that of the three-color data of the second pixel P2, any one thereof can be determined as three-color data of the padding data P0. The image processor 600 averages the three-color data of the padding data P0 and the three-color data of the first pixel P1 for respective colors and renders the same to generate RGBG data of the first pixel P1' corresponding to RGBG subpixels arrangement of the panel 100. The image processor 600 averages the three-color data of the first pixel P1 and the three-color data of the second pixel P2 for respective colors and renders the same to generate RGBG data of the second pixel P2' of the panel 100.

Referring to FIG. 4, smaller values for respective colors, Min{P1(r, g, b), P2(r, g, b)}, between the first and second pixel data P1 and P2, for example, the second pixel data P2, are determined as the three-color data of padding data P0. The padding data P0 and the first pixel data P1 are rendered for respective colors to generate RGBG data of the first pixel P1'. The first pixel data P1 and the second pixel data P2 are rendered for respective colors to generate RGBG data of the second pixel P2'. As a result, it can be ascertained that boundary artifacts are not generated even when a 1-line white and 1-line black pattern or a white pattern is positioned at a boundary and thus black data or full white data is used as padding data.

Figure 5:
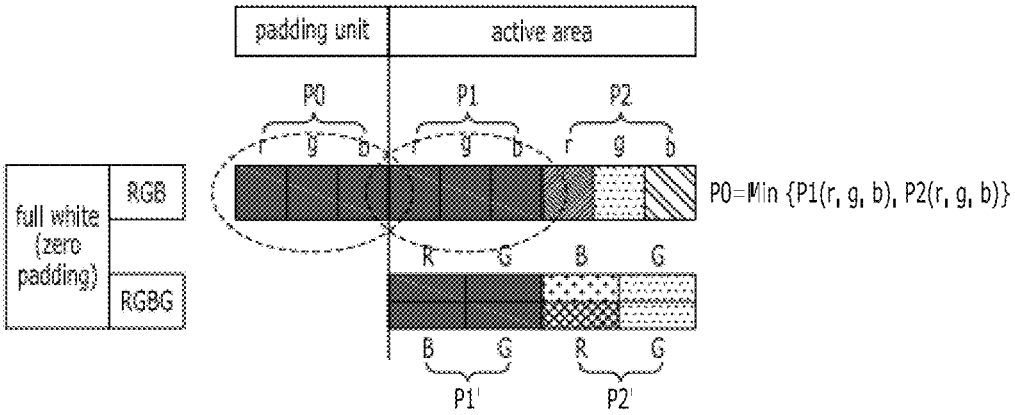
Figure 6:
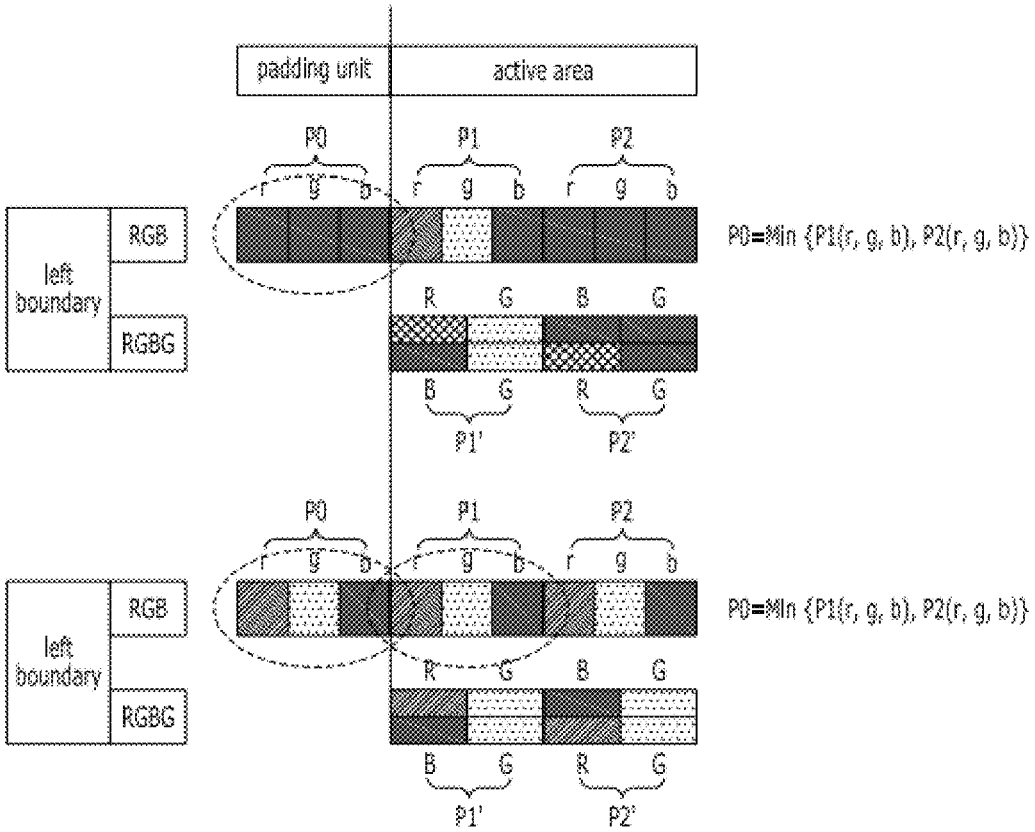
Figure 7:
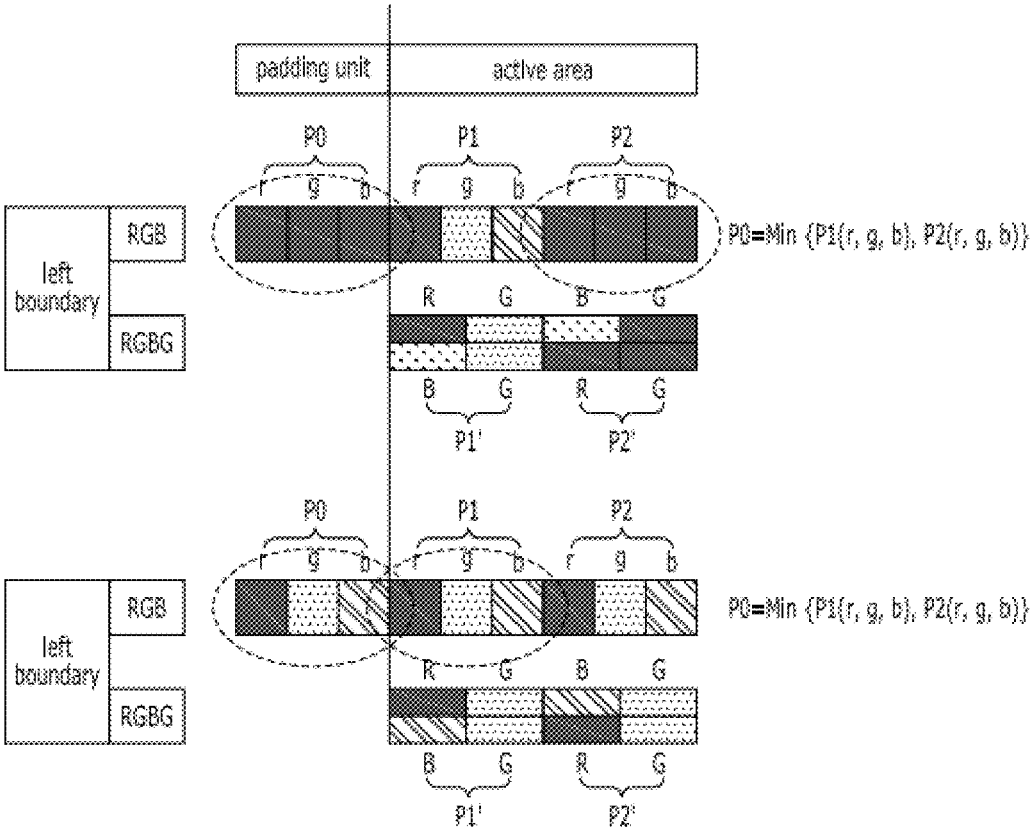
Figure 8:
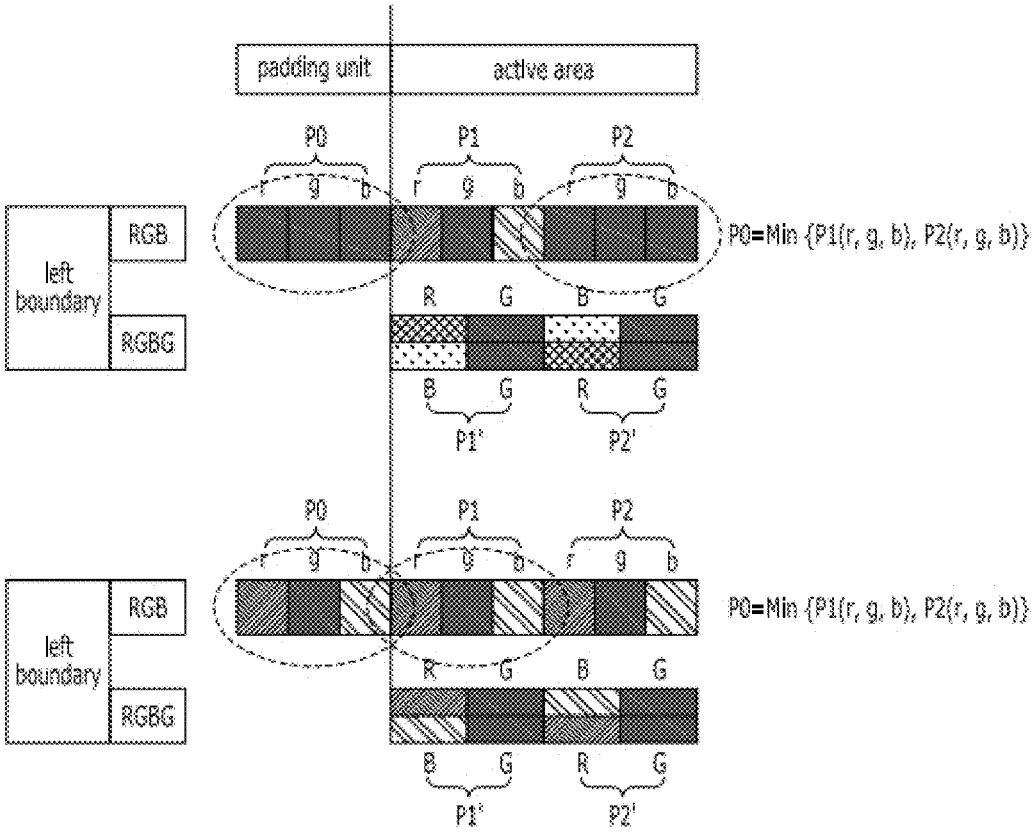
Figure 9:
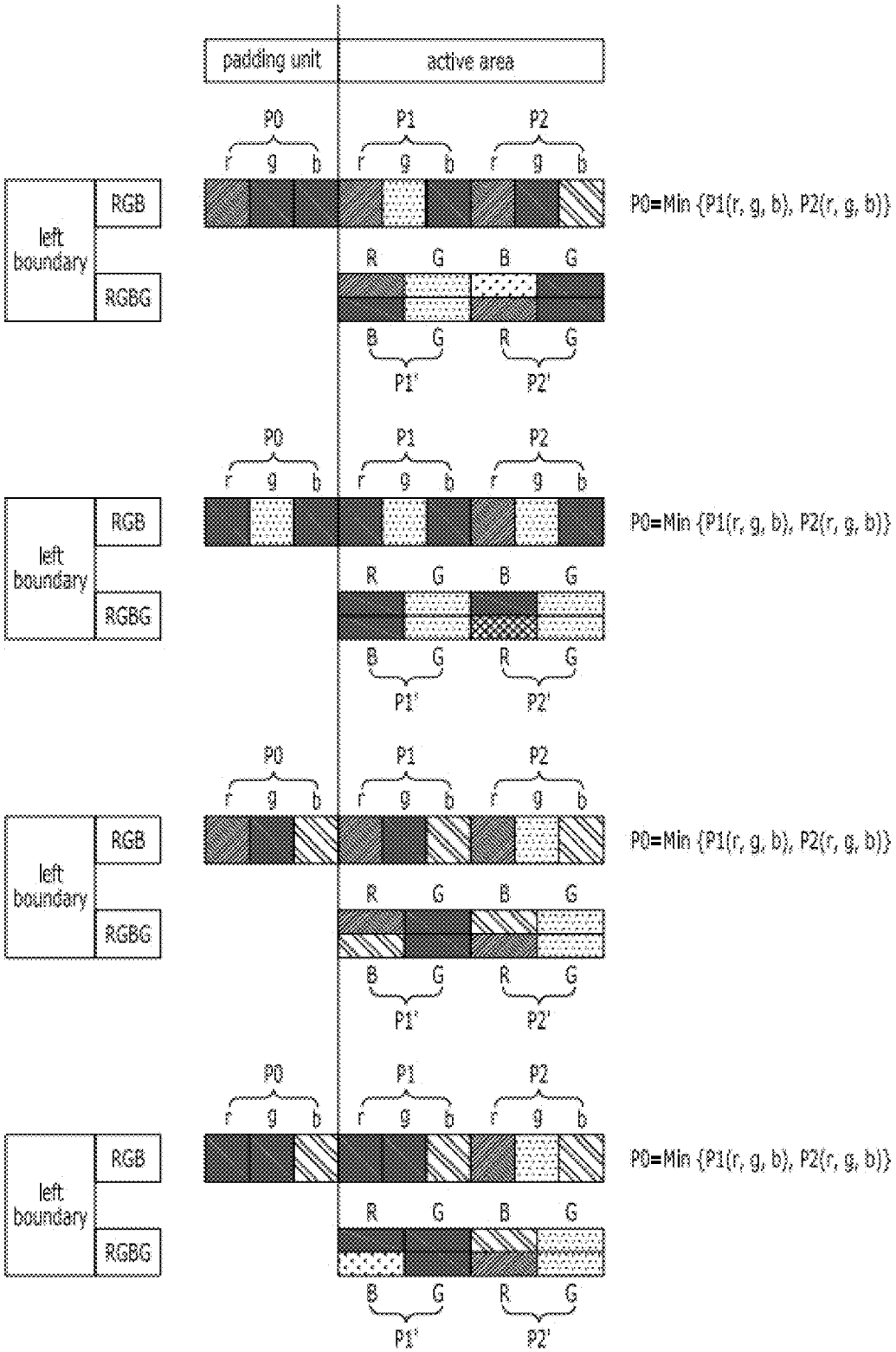

Referring to FIG. 5, smaller values for respective colors, Min{P1(r, g, b), P2(r, g, b)}, between three-color data of the first and second pixels P1 and P2 neighboring the left boundary in the active area, for example, the three-color data (black data) of the first pixel P1, are determined as the three-color data of padding data P0. And then a subpixel rendering process is performed. The padding data P0 and the first pixel data P1 are rendered for respective colors to generate RGBG data of the first pixel P1'. The first pixel data P1 and the second pixel data P2 are rendered for respective colors to generate RGBG data of the second pixel P2'. As a result, it can be ascertained that boundary artifacts due to padding data are not generated even when a 1-line white and 1-line black pattern is positioned at the boundary.

Referring to FIGS. 6 to 9, smaller values for respective colors, Min{P1(r, g, b), P2(r, g, b)}, between three-color data of the first and second pixels P1 and P2 neighboring the left boundary in the active area are determined as the three-color data of padding data P0. And then a subpixel rendering process is performed. The padding data P0 and the first pixel data P1 are rendered for respective colors to generate RGBG data of the first pixel P1'. The first pixel data P1 and the second pixel data P2 are rendered for respective colors to generate RGBG data of the second pixel P2'. As a result, it can be ascertained that boundary artifacts due to chromatic padding data are not generated even when various chromatic color patterns are positioned at the boundary and thus chromatic data is used as padding data.

As described above, according to the display device and the rendering method thereof according to an embodiment, it is possible to reduce artifacts irrespective of a pattern positioned at a boundary by determining pixel data having smaller data or luminance values for respective colors between first and second pixel values neighboring the boundary as padding data and rendering the determined padding data and the first pixel values, thereby improving definition.

It will be apparent to those skilled in the art that various modifications and variations can be made in the present disclosure without departing from the spirit or scope of the disclosure. Thus, it is intended that the present disclosure covers the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a panel in which each pixel is composed of subpixels of at least two colors from among three colors and has a different subpixel arrangement structure from those of pixels neighboring in a vertical direction and a horizontal direction, the panel having thereon an active area and a non-active area adjacent to the active area;

a panel driver for driving the panel; and a processor configured for determining whether a position of a current pixel is at either a right side or a left side of a boundary of the active area of the panel at which the position of the current pixel being an outermost pixel at either a right side or a left side of the boundary of the active area of the panel;

determining a padding data based on smaller color data values between current pixel data of the current pixel and neighboring pixel data of a neighboring pixel, the neighboring pixel being a left side of the current pixel when the position of the current pixel is at a right side of the boundary and the neighboring pixel being a right side of the current pixel when the position of the current pixel is at a left side of the boundary, the color data values including gradation values;

calculating the determined padding data and the current pixel data for respective colors to perform a subpixel rendering process; and outputting the rendered data to the panel driver, wherein, when the current pixel is a first pixel immediately neighboring a left side of the boundary of the active area, the processor determines smaller color data values for respective colors between first pixel data and second pixel data as padding data of the left side of the boundary and renders the padding data of the left side of the boundary and the first pixel data, and wherein, when the current pixel is a last M-th pixel immediately neighboring a right side of the boundary of the active area, the processor determines smaller color data values for respective colors between M-th pixel data and (M−1)-th pixel data as padding data of the right side of the boundary and renders the M-th pixel data and the padding data of the right side of the boundary, where M is a natural number greater than 1, and wherein the rendering of padding data with the first pixel data or the M-th pixel data include rendering red and blue color subpixels and exclude green color subpixels.

2. The display device of claim 1, wherein the processor is further configured to:

compare the current pixel data with the neighboring pixel data for respective colors; and determine smaller color data values or for the respective colors as the padding data, the color data values including luminance values.

3. The display device of claim 1, wherein the processor is further configured to calculate the current pixel data and the neighboring pixel data for the respective colors to perform the subpixel rendering process when the position of the current pixel is not at the boundary.

4. The display device of claim 1, wherein the panel has a structure in which a first pixel composed of green and red subpixels and a second pixel composed of green and blue subpixels are alternately arranged in the horizontal direction and the vertical direction.

5. The display device of claim 1, wherein the processor includes an image processor.

6. A rendering method of a display device, comprising:

determining whether a position of a current pixel is at either a right side or a left side of a boundary of a display panel at which the position of the current pixel being an outermost pixel at either a right side or a left side of the boundary of the display panel;

comparing smaller color data values between current pixel data of the current pixel and neighboring pixel data of a neighboring pixel;

determining a padding data based on smaller color data values between the current pixel data and the neighboring pixel data, the neighboring pixel being at a left side of the current pixel when the position of the current pixel is at a right side of the boundary and the neighboring pixel being a right side of the current pixel when the position of the current pixel is at a left side of the boundary; and calculating the determined padding data and the current pixel data for respective colors to perform a subpixel rendering process, when the current pixel is a first pixel immediately neighboring a left side of the boundary of an active area, determining smaller color data values for respective colors between first pixel data and second pixel data as padding data of the left side of the boundary and rendering the padding data of the left side of the boundary and the first pixel data, and when the current pixel is a last M-th pixel immediately neighboring a right side of the boundary of the active area, determining smaller color data values for respective colors between M-th pixel data and (M−1)-th pixel data as padding data of the right side of the boundary and rendering the M-th pixel data and the padding data of the right side of the boundary, wherein M is a natural number greater than 1, and wherein the rendering of padding data with the first pixel data or the M-th pixel data include rendering red and blue color subpixels and exclude green color subpixels.

7. The rendering method of claim 6, wherein comparing smaller values between current pixel data and neighboring pixel data includes:

comparing the current pixel data with the neighboring pixel data for respective colors.

8. The rendering method of claim 7, wherein determining the smaller values as padding data includes:

determining the smaller values for the respective colors as the padding data.

9. The rendering method of claim 8, wherein the respective colors include red, green, and blue.

10. A rendering method of a display device, comprising:

determining one or both of smaller gradation values or luminance values for respective colors between first and second pixel data neighboring a boundary as padding data, the determining including:

determining whether a position of a current pixel is at either a right side or a left side of a boundary of a display panel at which the position of the current pixel being an outermost pixel at either a right side or a left side of the boundary of the display panel;

comparing smaller values of one or both of smaller gradation values or luminance values between current pixel data of the current pixel and neighboring pixel data of a neighboring pixel; and determining a padding data based on smaller values between the current pixel data and the neighboring pixel data, the neighboring pixel being at a left side of the current pixel when the position of the current pixel is at a right side of the boundary and the neighboring pixel being a right side of the current pixel when the position of the current pixel is at a left side of the boundary, when the current pixel is a first pixel immediately neighboring a left side of the boundary of an active area of the display panel, determining smaller values for respective colors between first pixel data and second pixel data as padding data of the left side of the boundary and rendering the padding data of the left side of the boundary and the first pixel data, and when the current pixel is a last M-th pixel immediately neighboring a right side of the boundary of the active area, determining smaller values for respective colors between M-th pixel data and (M−1)-th pixel data as padding data of the right side of the boundary and rendering the M-th pixel data and the padding data of the right side of the boundary, wherein M is a natural number greater than 1, and wherein the rendering of padding data with the first pixel data or the M-th pixel data include rendering red and blue color subpixels and exclude green color subpixels.

11. The method of claim 10, wherein, first red data and first blue data included in the first pixel data are respectively compared with second red data and second blue data included in the second pixel data, and smaller red data between the first red data and the second red data and smaller blue data between the first blue data and the second blue data are determined as the padding data.

* * * * *